United States Patent [19]

Joyner, Jr.

[11] 4,067,289

[45] Jan. 10, 1978

[54] PORTABLE MECHANICAL ALARM FOR DOORS, WINDOWS AND THE LIKE

[76] Inventor: Curtis B. Joyner, Jr., 112 Shore Acres, Mount Dora, Fla. 32757

[21] Appl. No.: 715,308

[22] Filed: Aug. 18, 1976

[51] Int. Cl.[2] ..... G08B 13/08

[52] U.S. Cl. ..... 116/77; 116/86

[58] Field of Search ..... 116/85, 86, 91, 95, 116/90, 75, 77, 82, 16

[56] References Cited

U.S. PATENT DOCUMENTS

| | | | |
|---|---|---|---|
| 732,727 | 7/1903 | Fletcher | 116/91 |
| 1,633,374 | 6/1927 | Denser | 116/86 |
| 1,859,345 | 5/1932 | Schantz | 116/86 |
| 2,084,841 | 6/1937 | Fleischmann | 116/16 |
| 2,447,527 | 8/1948 | Olvis | 116/16 |
| 3,131,668 | 5/1964 | Stebbins | 116/91 |

*Primary Examiner*—Daniel M. Yasich
*Attorney, Agent, or Firm*—Duckworth, Hobby & Allen

[57] ABSTRACT

A portable alarm useful for indicating unauthorized entry at doors and windows includes a housing and a bell casing mounted in the housing with a clacker arm rotatably mounted within the casing and adapted to create an audible signal. A trigger arm is mounted within the housing, extending into to the bell casing and is biased against the clacker arm in a first direction. An actuator including an L-shaped arm and a pressure plate is pivotably mounted along an edge of the housing such that the lever arm extends outside the housing and with the pressure plate dimensioned so as to exert a pressure against the trigger arm in a second direction opposing the first direction responsive to a movement of the lever arm. The pressure plate is biased away from the trigger arm, until such time as a substantial force against the pressure plate overcomes the bias and forces the other end of the trigger arm out of engagement with the clacker arm, thereby effecting the audible signal.

7 Claims, 7 Drawing Figures

PORTABLE MECHANICAL ALARM FOR DOORS, WINDOWS AND THE LIKE

BACKGROUND OF THE INVENTION

1. Field of the Invention

The present invention relates to alarm devices, and in particular relates to portable and mechanical burglar alarms for indicating unauthorized entry into doors, windows and the like.

2. Description of the Prior Art

A plurality of prior art arrangements have been disclosed which provide a simple, mechanical burglar alarm for mounting adjacent a door, window or the like to indicate unauthorized entry upon rotational movement of the door about its hinges, or linear motion of the window along the window housing.

For example, Schantz, in U.S. Pat. No. 1,859,345 discloses such an arrangement which employs a rotatable lever arm which alternately engages and disengages a trigger pin directly biased against the alarm bell so as to prevent vibration of the bell until such time as the lever arm is actuated responsive to movement of a door, or window adjacent which the alarm is mounted.

A somewhat similar arrangement is disclosed by Rycraft in U.S. Pat. No. 849,129, which teaches a spring-type lever arm coupled to a similar trigger pin for alternately engaging and disengaging the clacker arm of the bell. See also U.S. Pat. No. 149,375 to Connell.

Ambrose, in U.S. Pat. No. 1,218,038, teaches an arrangement remarkably similar to that disclosed by Shantz, also employing a lever arm and a trigger pin actuated in direct response to the movement of the lever arm. A further disclosure of such arrangements is taught by Lasher in U.S. Pat. No. 160,918.

In U.S. Pat. No. 2,953,366, Demers discloses a lever-actuated gear and crank arrangement for effecting operation of the bell clacker arm. A somewhat similar arrangement is disclosed by Smillie in U.S. Pat. No. 3,955,519.

In U.S. Pat. No. 2,447,527, Olvis discloses a window-mounted alarm system employing a horizontally extending actuator rod which is biased against the window jam so as to detect movement of the window in the vertical direction.

SUMMARY OF THE INVENTION

The present invention contemplates a portable alarm for indicating unauthorized entry into doors, windows and the like and comprises in combination a housing and a bell casing mounted in the housing, with a clacker arm rotatably mounted within the casing and adapted to strike the inner periphery of the casing responsive to rotation thereof, in order to create an audible signal. Means are provided for rotating the clacker arm, and a trigger arm is mounted with one end against the inside of the housing with the other end extending adjacent to the casing and clacker arm. A first biasing means is provided for biasing the other end of the trigger arm in a first direction against the clacker arm to prevent rotation. An actuator having a lever arm and a pressure plate extending in a substantial angle with respect to the lever arm is included, the actuator pivotably mounted along an edge of the housing such that the lever arm extends outside the housing. The pressure plate and lever arm cooperate to exert a pressure against the trigger arm in a second direction opposing the first direction responsive to movement of the lever arm. Second biasing means for biasing the pressure plate out of contact with the trigger arm is also included.

In operation, a substantial force against the lever arm in substantially the first direction causes the pressure plate to overcome the second and first biasing means, respectively, and force the other end of the trigger arm out of engagement with the clacker arm, thereby effecting the audible signal.

In a preferred embodiment, the portable alarm in accordance with the present invention includes an arming lever extending through the housing and the casing and is adapted to prevent rotation of the clacker arm until the arming lever has been moved into the arming position.

The construction of the portable alarm in accordance with the present invention provides a rugged, low cost alarm which can be manufactured in a simple manner.

In a second embodiment, the first and second biasing means comprises a single spring.

THE DRAWING

DETAILED DESCRIPTION

A preferred embodiment of the portable burglar alarm in accordance with the present invention will now be described with reference to the drawings.

Figure 1:
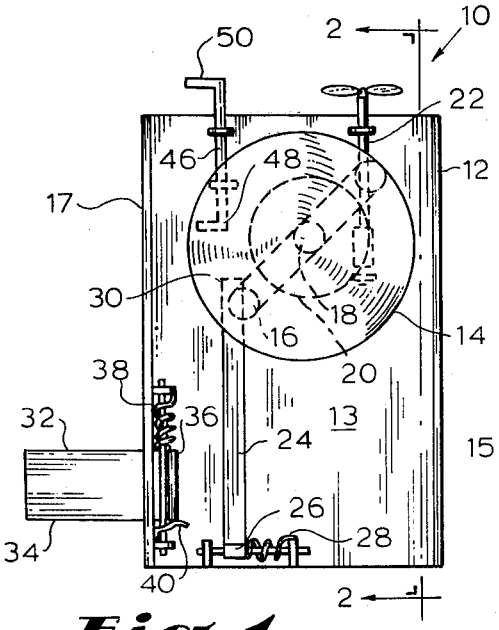
FIG. 1 is a top plan view of one embodiment of the portable alarm in accordance with the present invention.
Figure 2:
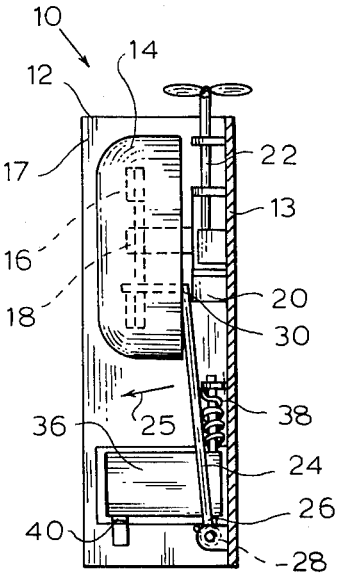
FIG. 2 is a side view, partially in cross-section, of the apparatus shown in FIG. 1.
Figure 4:
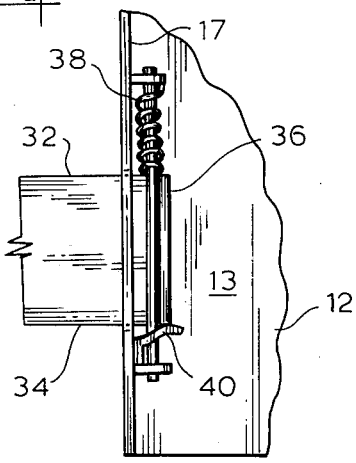
FIG. 4 is a top plan, cut-away view of a portion of the apparatus shown in FIG. 1.

With specific reference to FIGS. 1 and 2, the portable alarm, referred to generally as 10, includes a housing 12 of conventional design which may include a plate 13 and opposing side surfaces 15, 17.

Mounted within the housing 12 is a conventional bell casing 14 having a clacker arm 16 rotatably mounted within the bell casing on a shaft 18, the shaft being rotated by a conventional spring 20, shown as a block diagram 20 in FIG. 2. The spring 20 which rotates the shaft 18 may be wound by a key 22 extending outside the housing 12. As described thus far, the combination of the bell casing 14 and the elements contained therein is commercially available from several sources.

Referring again to FIGS. 1 and 2, the alarm 10 is provided with a trigger arm 24 having one end 26 mounted against the plate 13 at a distance from the bell casing 14, and being biased in a first direction 25 by a spring 28 to which the one end 26 of the trigger arm 24 is mounted, the first direction being depicted by the arrow 25 in FIG. 2.

The other end 30 of the trigger arm 24 extends through the bell casing 14 and adjacent the clacker arm 16, and when the trigger arm 24 is properly biased by the spring 28 the end 30 prevents rotation of the clacker arm 16 (note FIG. 1).

Figure 3:
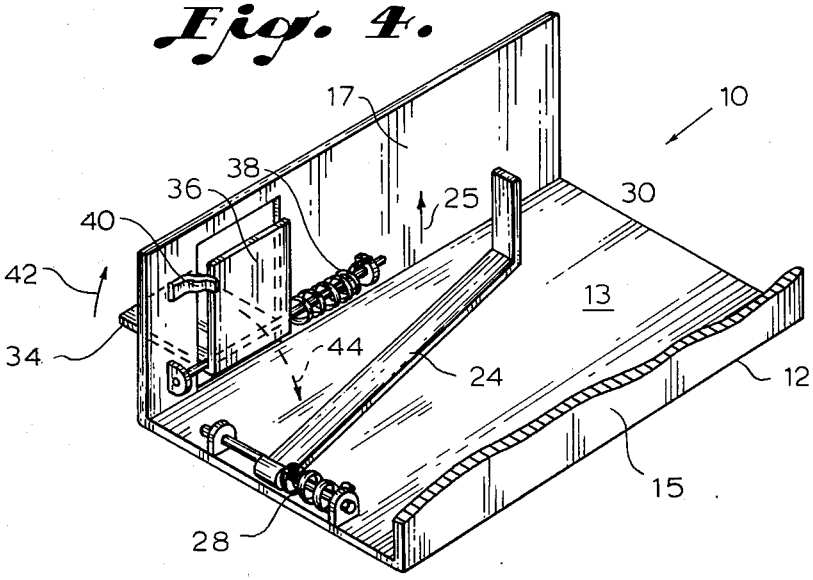
FIG. 3 is a perspective, partial assembly view of a portion of the apparatus shown in FIG. 1.

The alarm 10 further includes an actuator comprising an L-shaped member 32 having a first lever arm 34 and a second arm forming a pressure plate 36 extending substantially normal to the lever arm 34. The L-shaped member 32 is pivotably mounted along the sides 17 of the housing 12 such that the lever arm 34 extends outside of the casing 10 while the pressure plate is within the housing. The pressure plate 36 is dimensioned so as to exert a pressure against the trigger arm 24 between the ends 28, 30 thereof in a second direction (note arrow 44 in FIG. 3) opposing the first direction 25 responsive to movement of the lever arm 34 in a direction substantially parallel to the first direction, as is depicted by the arrow 42 in FIG. 3.

A spring clip 40 mounted along the second side 17 of the housing 12 biases the pressure plate 36 out of contact with the trigger arm 24 until such time as a sufficient force is exerted against the lever arm so as to overcome the biasing of the spring clip 40. Additionally, a second spring 38 is mounted coaxial with the L-shaped member 32 to provide a bias against the spring clip, but which spring 38 is selected so as to be unable, in and of itself, to overcome the bias of the spring clip 40. In this way, the only force required against the lever arm 34 to overcome the bias of the spring clip 40 is that force which must be added to the bias of the spring 38 to overcome the bias of the spring clip 40.

Again noting FIG. 1, the alarm 10 is provided with an arming lever 46 having one end 48 extending through the bell casing and adapted to prevent rotation of the clacker arm 16 until such time as the other end 50 of the arming lever is moved a sufficient distance to move the one end 48 out of the path of the clacker arm 16; for example, this can be accomplished by rotating the one end 48 90°. In this way, the arming lever 46 prevents inadvertent operation of the alarm until such time as the alarm is properly installed adjacent the door, window or the like and the arming lever 46 is thereafter moved the appropriate position.

It will be understood by those skilled in the art that the housing 12 may be temporarily attached to the door jam, window jam or the like by utilizing a C-clamp-type connector, or other suitable means. Alternatively, the alarm may be permanently attached by the use of screws or similar fasteners extending through the plate 13 and into the door jam or similar permanent structure.

In use, movement of the door about its hinges, or the window in a vertical manner effects rotation of the lever arm 34, causing the pressure plate 36 to overcome the bias of the spring clip 40. The pressure plate continues to travel in the direction of the trigger arm 24, until such time as the pressure plate exerts a sufficient force so as to cause the other arm 30 of the trigger arm 24 to move out of contact with the clacker arm 16. Assuming that the spring drive 20 associated wth the shaft 18 and the clacker arm 16 has been wound by operation of the key 22, the clacker arm 16 rotates about the inner periphery of the bell casing 14 effecting an audible signal in the desired manner.

Figure 5:
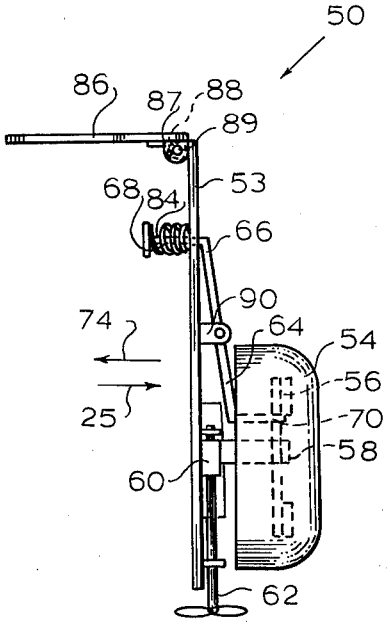
FIG. 5 is a side view of a second embodiment in accordance with the present invention.
Figure 6:
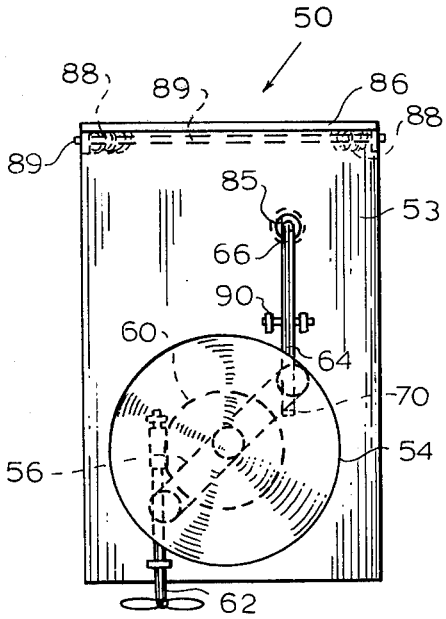
FIG. 6 is a front view of the embodiment of FIG. 5.
Figure 7:
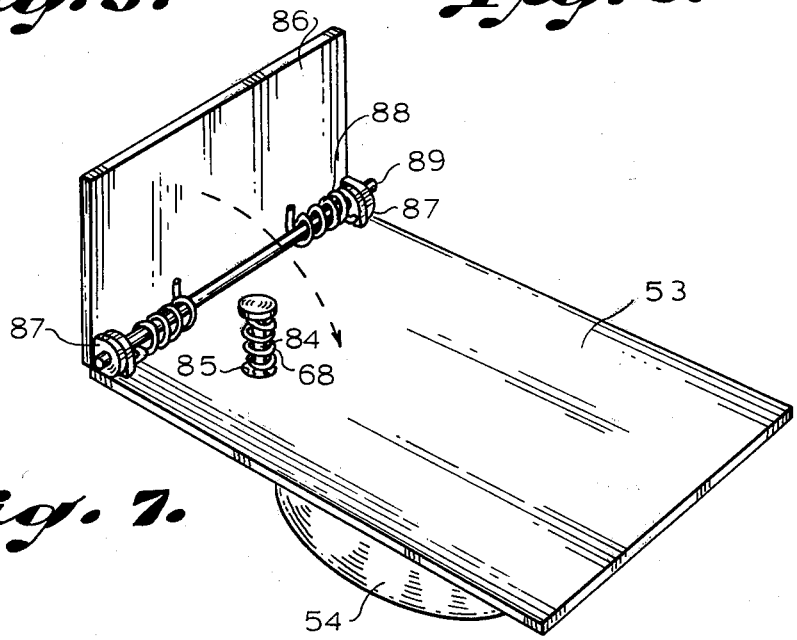
FIG. 7 is a rear, perspective view of the embodiment of FIG. 5.

A second embodiment of an alarm in accordance with the present invention is shown in FIGS. 5–7 and described with reference thereto. The second embodiment, referred to generally to as 50, includes a mounting plate 53 and a bell casing 54 having a clacker arm 56 mounted on a rotating shaft 58 driven by a spring 60. Again, all of the elements described thusfar are conventional. The spring 60 may be wound by a key 62 extending across the plate 53.

The alarm 50 is provided with a trigger arm 64 which is pivotably mounted by a fulcrum 90 against the inside surface of the plate 53 such that one end 66 of the trigger arm bears against the inside surface of the plate 53, with the other end 70 extending into the bell casing and adjacent the clacker arm 56 so as to prevent rotation of the clacker arm in the manner described with reference to the embodiment of FIG. 1.

The alarm 50 is further provided with a lever arm 84 which extends through a hole 85 in the plate 53. The lever arm 84 may be formed integrally with the trigger arm 64, and is provided with a spring 68 which biases the second end 70 of the trigger arm 64 in a first direction 25, so as to prevent rotation of the clacker arm 56.

A pressure plate 86 is mounted at one extremity of the mounting plate 53 by way of a rod 89 which is biased with a spring 88, the rod 89 being mounted at the extremity of the plate 53 via brackets 87.

In use, the alarm 50 may be mounted in a door jam or window sash in such a manner with the pressure plate 86 rotated out of contact with the lever arm 84. At such time as an unauthorized entry through the door or window is made, the bias of the spring 88 causes the pressure plate 86 to move downward, which in turn usually causes the entire alarm 50 to spring away from the door or window. The pressure plate 86 continues to rotate toward the lever arm 84, until such time as the pressure plate overcomes the bias of the spring 68, thus forcing the end 70 of the trigger arm in the direction 74, thereby allowing the clacker arm 56 to rotate and strike the inner periphery of the bell casing 54 causing the desired audible alarm.

I claim:

1. A portable alarm for selective, temporary attachment adjacent a closure such as a door, window, or the like, and useful for indicating unauthorized entry into said closure, comprising in combination:

a housing;

a bell casing mounted in said housing;

a clacker arm rotatably mounted within said casing and adapted to strike the inner periphery of said casing responsive to rotation thereof to create an audible signal;

means for rotating said clacker arm;

a trigger arm rotatably mounted with an end thereof adjacent a side of said housing and having the other end thereof extending into said casing and adjacent said clacker arm;

first biasing means for biasing said other end of said trigger arm in a first direction against said clacker arm to prevent rotation thereof;

an actuator having a lever arm and a pressure plate, said actuator pivotably mounted along an edge of said housing such that said lever arm extends outside said housing, and with said pressure plate dimensioned so as to cooperate with said lever arm to move said trigger arm in a second direction opposing said first direction responsive to movement of said lever arm;

second biasing means for biasing said actuator plate contact with said trigger arm; and wherein a force caused by movement of the closure against said lever arm substantially in said first direction causes said lever arm to overcome said second and first biasing means, respectively, and forces said other end of said trigger arm out of engagement with said clacker arm, thereby effecting said audible signal.

2. The portable alarm recited in claim 1 further comprising an arming lever extending through said housing and casing and bearing against said clacker arm to prevent rotation of said clacker arm until said arming lever is moved out of said casing.

3. The portable alarm recited in claim 2 wherein said actuator comprises an L-shaped member with said lever arm and said pressure plate each comprising one leg of said member, said pressure plate mounted within said housing.

4. The portable alarm recited in claim 3 further comprising third biasing means for biasing said pressure plate away from said edge of said housing.

5. The portable alarm recited in claim 4 wherein said first biasing means comprises a spring biased against said trigger arm at said one end thereof.

6. The portable alarm recited in claim 5 wherein said second biasing means comprises a spring clip mounted against the inside of said housing.

7. The portable alarm recited in claim 1 further comprising:

said lever arm formed integrally with said trigger arm;

said pressure plate mounted along one edge of said housing;

means for biasing said pressure plate against said lever arm, so as to overcome said first and second biasing means to thereafter cause said trigger arm to disengage said clacker arm.

* * * * *